United States Patent [19]

Austin

[11] 4,154,297

[45] May 15, 1979

[54] LIFT GAS HEAT EXCHANGER

[75] Inventor: Douglas L. Austin, Winnie, Tex.

[73] Assignee: Sun Oil Company, Dallas, Tex.

[21] Appl. No.: 858,483

[22] Filed: Dec. 8, 1977

[51] Int. Cl.[2] ..... E21B 43/12

[52] U.S. Cl. ..... 166/61; 166/62; 166/302; 165/163

[58] Field of Search ..... 166/61, 62, 302, 303; 165/163

[56] References Cited

U.S. PATENT DOCUMENTS

| | | | |
|---|---|---|---|
| 2,458,826 | 1/1949 | Blumberg et al. | 165/163 X |
| 2,911,047 | 11/1959 | Henderson | 166/61 |
| 3,062,289 | 11/1962 | Eades | 166/61 |
| 3,749,163 | 7/1973 | Waters | 166/302 X |

*Primary Examiner*—Ernest R. Purser
*Assistant Examiner*—Nick A. Nichols, Jr.
*Attorney, Agent, or Firm*—J. Edward Hess; Donald R. Johnson; James H. Phillips

[57] ABSTRACT

In order to prevent freezing of the input lift gas in an oilwell in which gas under pressure is used to lift the well fluids, a heat exchanger is provided which serves to heat the input gas from the warm well fluids. The heat exchanger includes an outer casing and a coaxial tubing which is in line with the well fluid flow. The casing is sealed, and the tubing within the casing is provided with openings which permit the circulation of well fluids in the space between the casing inner wall and the tubing. Relatively small stainless steel tubing is spirally wrapped, in two spaced apart sections, around the tubing within the casing, and access parts are provided to permit the passage of input lift gas through the wrapped tubing prior to its injection into the well. The two wrapped tubing sections are coupled by a gas flow control valve external to the casing.

3 Claims, 5 Drawing Figures

LIFT GAS HEAT EXCHANGER

This invention relates to the fluid well arts, and more particularly, to such wells which employ artificial lift constituting the injection of a gas under pressure into the well in order to force the well fluids to the surface.

When fluid wells, particularly oil wells, are first completed, a natural drive usually exists in the system which will force the oil to the surface. At the time oil was forming and accumulating in reservoirs, pressure and energy in the gas and salt water associated with the oil were also being stored to be later available to assist in producing the oil and gas from the underground reservoir to the surface. In nearly all cases, oil in an underground reservoir has dissolved in it varying quantities of gas that emerges and expands as the pressure in the reservoir is reduced. As the gas escapes from the oil and expands, it drives oil through the reservoir toward the wells and assists in lifting it to the surface. Reservoirs in which oil is produced by dissolved gas escaping and expanding from within the oil are called "dissolved gas drive" reservoirs. In many cases, there exists more gas with the oil in a reservoir than the oil can hold dissolved in it under the existing conditions of pressure and temperature in the reservoir. This extra gas, being lighter than the oil, occurs in the form of a cap of gas over the oil. Such a gas cap is an important additional source of energy, for, as production of oil and gas proceeds and the reservoir pressure is lowered, the gas cap expands to help fill the pore spaces formerly occupied by the oil and gas produced. This "gas cap drive" production process is substantially more effective than "dissolved gas drive" alone.

Where the formation containing an oil reservoir is fairly uniformly porous and continous over a large area compared to the size of the oil reservoir, vast quantities of salt water exist in surrounding parts of the same formation, often directly in contact with the oil and gas reservoir. These tremendous quantities of salt water occur under pressure and provide a great additional store of energy to aid in producing oil and gas. The energy supplied by the salt water comes from expansion of the water as pressure in the petroleum reservoir is reduced by production of oil and gas. The expanding water moves into the regions of lowered pressure in the oil and gas saturated portions of the reservoir caused by production of oil and gas and retards the decline in pressure. In this way, the expansive energy in the oil and gas is conserved. The expanding water also moves and displaces oil and gas in an upward direction out of lower parts of the reservoir. This "water drive" is generally the most efficient oil production process.

However, those skilled in the art understand that the energy stored in these natural drive processes is finite, and when pressures in the oil reservoir have fallen to the point where a well will not produce by natural energy, some method of artificial lift must be used. Artificial lift is usually obtained by one of two methods; viz.: (1) a mechanical pump usually characterized by the well-known walking beam pumping unit situated at the wellhead, or (2) the injection of high pressure gas to simulate natural gas drive as described above. The present invention is directed to apparatus employed in the injection of high pressure gas into a well to artificially lift the fluids to the surface.

There are many different types of gas lift installations, but this method of lifting oil is accomplished by one or by a combination of the following processes. (1) aeration (mixing of the gas and liquid) of the fluid column in the well; (2) work of expansion of the compressed gas; and (3) displacement of fluid by the compressed gas. Present gas lift practices include the use of specially designed gas lift valves which are installed on the tubing string. These valves are placed in openings spaced along the tubing string and are run to provide an opening between the casing and tubing.

In operation, gas under pressure is injected into the space between the casing and tubing and enters the tubing through the gas lift valves. Fluid that is standing in the tubing above the gas inlet port is displaced, lightened by mixing with the gas, and is raised to the surface by the expanding gas. If the well is able to maintain a column of fluid above the point of injected gas, the well is said to be under a continuous flow gas lift. In a well where considerable time is needed for fluid to build up in the tubing, gas is injected into the well in batches which brings the fluid to the surface in slugs. This type of production is known as intermittent gas lift.

A well known problem associated with the injection of high pressure gas in a well to effect artificial lift is a tendency for the gas to freeze at points where a pressure drop takes place. Such pressure drops may occur, for example, in the region of a flow rate control valve. Since many well fluids are relatively hot (for example, on the order to 130° F.), it has been proposed in the past to employ a heat exchanger for transferring heat from the well fluids to the apparatus through which the lift gas is being expanded. The known prior art examples of such heat exchangers are generally bulky, require considerable experienced manpower to connect them to the well, are expensive, inefficient, and often can cause excessive back pressure in the flow line system. Thus, those skilled in the art will appreciate that it would be highly desirable to provide an improved heat exchanger to prevent freeze-up of lift gas by the extraction of heat from well fluids.

It is therefore a broad object of this invention to provide an improved heat exchanger.

It is another object of this invention to provide an improved heat exchanger for effecting the transfer of heat from well fluids to an injection gas employed in producing artificial lift in a well.

It is yet another object of this invention to provide such an improved heat exchanger which is relatively simple and inexpensive to fabricate and install into the injection system.

Briefly, these and other objects of the invention are achieved, according to a presently preferred embodiment, by providing a chamber between a tubing section, which is in line with the well fluid flow, and a casing, which tubing section is coaxially disposed within the casing. The chamber is sealed off at each end of the casing, and slots or the like are provided in the tubing section within the chamber in order that well fluids may freely circulate therein. First and second spiral sections of stainless steel tubing are wrapped around the tubing within the chamber, and the ends of each section are brought through the casing walls. A flowrate control valve joins the two sections, and a source of lift gas is connected to one of the remaining ends while the other end is connected to the well casing. Thus, cold lift gas from the source enters the first section and is heated prior to passage through the flowrate control valve. As the gas passes through the flowrate control valve, it again becomes cold due to the pressure drop across the valve. The gas then reenters the heat exchanger interior and passes through the second section of coil about the tubing where it is re-heated prior to injection into the well casing. As a result of the efficiency of this unit, freeze-up problems are totally eliminated, and the size is sufficiently small that the unit can be carried by one man and connected by only two men in a very short period of time.

The subject matter of the invention is particularly pointed out and distinctly claimed in the concluding portion of the specification. The invention, however, both as to organization and method of operation may best be understood by reference to the following description taken in connection with the accompanying drawing of which:

Figure 3:
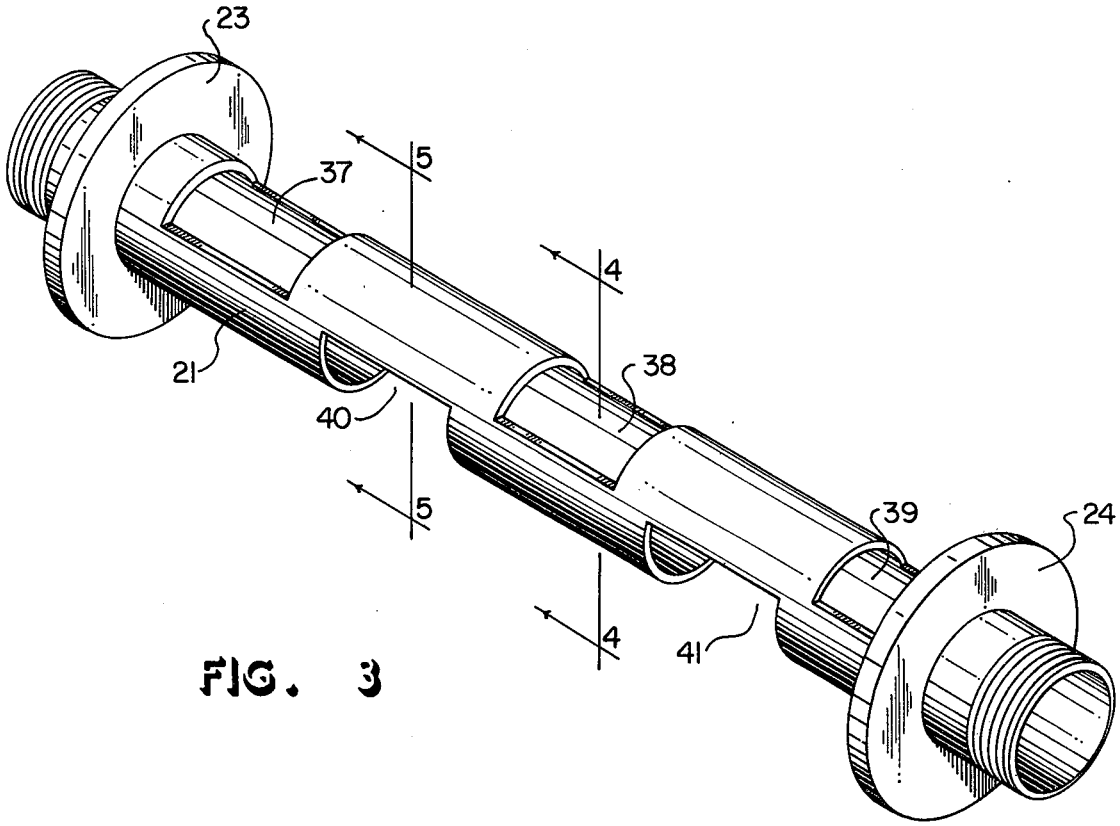
FIG. 3 is a plan view of an internal tubing element of the heat exchanger.
Figure 4:
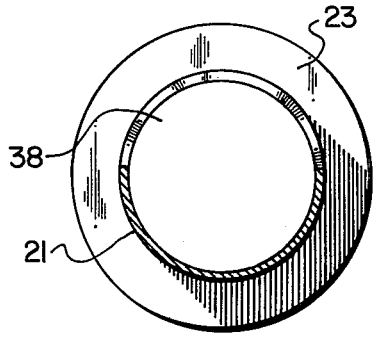
Figure 5:
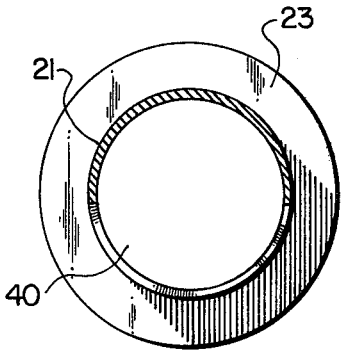

FIGS. 4 and 5 are cross-sectional views taken, respectively, along the lines 4—4 and 5—5 of FIG. 3.

Figure 1:
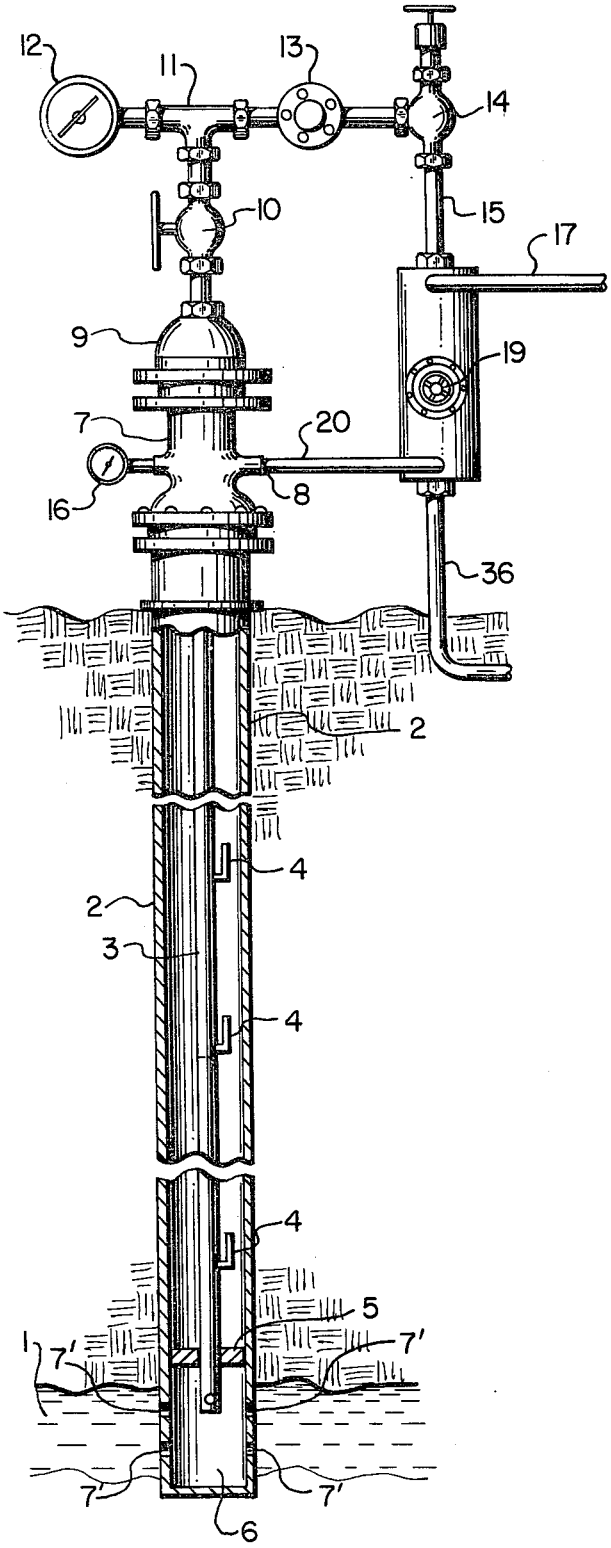
FIG. 1 is a representation of an oil well in which lift is artificially effected by the injection of a high pressure gas and which employs the heat exchanger according to the present invention.

Referring now to FIG. 1, a well for producing oil from a reservoir 1 which lacks sufficient pressure to be self lifting is shown. The well includes a casing 2 enclosing a tubing string 3 which extends from the surface into the producing sands region. The tubing string 3 is preferably fitted with a plurality of spaced-apart gas lift valves 4 of conventional design. A packer 5 disposed between the casing and the tubing string just above the producing region confines the well fluids to the tubing string when in transit to the surface. Oil from the producing region 1 flows through perforations 7' to enter the chamber 6 beneath the packer 5.

At the well head, a casing head 7 seals off the upper end of the casing 2 and permits access at a port 8 for injection of lift gas as will be described hereinafter. The well fluids pass through a tubing head 9 and a valve 10 to a tee fitting 11 which has a gauge 12 connected to one side. The other side of the tee fitting 11 is connected, through a tubing flow valve 13 and a choke 14, to a flow line 15 which transmits the well fluids to a heat exchanger 18. From the heat exchanger, the well fluids pass, through a flow line 36, to a storage point or the like, not shown.

High pressure gas, of any suitable type and from any suitable source, is received through gas line 17 by the heat exchanger 18 which is fitted with an injection gas flowrate valve 19 intermediate along its length. Injection gas passes from the heat exchanger 18 through a line 20 to the port 8 of the casing head 7 for injection into the casing. A casing pressure gauge 16 is connected to the casing head 7 to permit monitoring the artificially elevated pressure within the casing caused by the injection of the lift gas.

In operation, the natural pressure remaining in the formation is typically sufficient to force oil from the formation into the lower section of the tubing string 3. The pressurized lift gas is injected at the port 8 in the casing head 7 into the space between the casing 2 and tubing string 3 and enters the tubing through the gas lift valves 4. Fluid that is standing in the tubing above one or more of the gas lift valves 4 is displaced, lightened by mixing with the gas, and is raised to the surface by the expanding gas. If the well is unable to maintain a column of fluid for continuous flow, the gas may be injected intermittently to bring the fluid to the surface in slugs.

Figure 2:
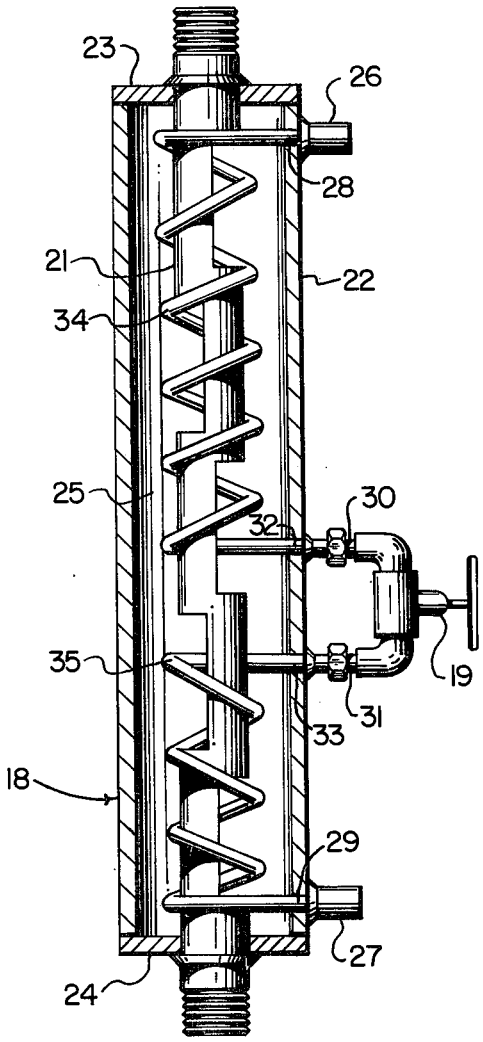
FIG. 2 is a partially cut-away detail view of the heat exchanger used in the installation shown in FIG. 1.

Attention is now directed to FIG. 2 which is a partially cutaway view illustrating the detailed structure of the heat exchanger 18 depicted in the system of FIG. 1. It will be observed that the heat exchanger 18 includes a coaxial structure comprising an inner tubing 21 in line with the well fluid flow and an outer casing 22 with end plates 23 and 24 which serve to seal off the chamber 25 between the outer walls of the tube 21 and the inner walls of the casing 22. A pair of collars 26 and 27 are welded to the outside of the casing 22 just inboard from the end plates 23 and 24, respectively. The collars 26 and 27 are generally directed radially outwardly and are disposed in alignment with respective apertures 28 and 29 through the walls of the casing 22. Intermediate the length of the casing 22, a second pair of longitudinally spaced apart collars 30 and 31, which are respectively aligned with a corresponding pair of apertures 32 and 33 through the walls of the casing 22 are provided. The valve 19 is fixed in series relationship between the collars 30 and 31 and hence between the apertures 32 and 33.

A first section 34 of relatively small stainless steel tubing extends from the aperture 28 to the aperture 32 and is spirally wrapped about the outer surface of the tube 21. Similarly, a second section 35 of relatively small tubing is connected between the aperture 33 and aperture 29 and also spirally wrapped about the outer walls of the tubing 21. In a presently preferred embodiment of the apparatus, it has been found desirable to make the first section 34 of spirally wrapped tubing somewhat longer than the second section 35. Thus, it will be seen that pressurized gas received at the collar 26 passes through the first section 34 of spirally wrapped tubing, out of the case through the aperture 32, through the valve 19, back into the chamber 25 through the aperture 33, through the somewhat shorter second section 35 of spirally wrapped tubing and out the aperture 29 from which it passes to the casing for injection into the well as shown in FIG. 1.

Referring briefly to FIGS. 3, 4, and 5, the inner tubing 21 is shown apart from the remainder of the apparatus in order to illustrate one configuration which has been found to be very effective. As best shown in FIG. 3, several half-sections, 37, 38 and 39 are cut away from the upper half of the inner tubing 21 to provide a cross-section at those positions which is shown in FIG. 4. Similarly, a pair of half-sections 40 and 42 are cut away from the bottom half of the inner tubing 21 to give a cross-section which is illustrated in FIG. 5. The cutaway sections 37 and 41 are alternately distributed along the length of the inner tubing 21 between the upper and lower halves thereof. Such a distribution permits the desired high rate of fluid communication between the inside and outside of the inner tubing 21 without unduly adversely affecting its structural rigidity. Those skilled in the art will understand that a high degree of fluid communication between the inside and outside of the inner tubing 21 can be obtained by diverse means. For example, a multitude of radially-directed apertures through the wall of the inner tubing 21 would function well and be particularly strong; however, the time consumed in preparing the inner tubing 21 according to such an approach renders it impractical in most applications, and the configuration shown in FIG. 3 has, in practice, been found to be imminently suitable for the intended purpose.

While the principles of the invention has now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

What is claimed is:

1. A heat exchanger for transferring heat from well fluids to pressurized gas which is subsequently injected into a well from which the well fluids are obtained, which heat exchanger comprises:

(A) a cylindrical casing;

(B) an inline tubing extending longitudinally through said casing and adapted to be connected inline with the well fluid flow;

(C) means for sealing off the ends of said casing around said inline tubing to provide a chamber beneath the inner walls of said casing and the outer wall of said inline tubing;

(D) aperture means through the wall of said inline tubing within said casing for establishing fluid communication between said chamber and the interior of said inline tubing;

(E) injection gas tubing means spirally wrapped around a portion of the length of said inline tubing, in first and second spaced-apart sections; and (F) aperture means through the wall of said casing coupled to ends of said injection gas tubing for establishing inlet and outlet means for said injection gas tubing external to said casing, said aperture means including means establishing fluid communication external to said casing for the ends of said sections intermediate the length of said casing.

2. The heat exchanger of claim 1 which further includes a gas flowrate control valve disposed inline between said first and second spaced-apart sections.

3. The heat exchanger of claim 2 in which said injection gas tubing is fabricated from stainless steel.

* * * * *